US006403023B1

(12) United States Patent
Kim et al.

(10) Patent No.: US 6,403,023 B1
(45) Date of Patent: Jun. 11, 2002

(54) METHOD FOR MAKING POROUS METALS

(75) Inventors: Dong Yik Kim; Sung Kyun Kim, both of Junrapuk-do (KR)

(73) Assignee: Future Metal Co., Ltd., Seoul (JP)

( * ) Notice: Subject to any disclaimer, the term of this patent is extended or adjusted under 35 U.S.C. 154(b) by 0 days.

(21) Appl. No.: 09/694,331

(22) Filed: Oct. 24, 2000

(51) Int. Cl.[7] ..... B22F 3/10
(52) U.S. Cl. ..... 419/2; 419/47
(58) Field of Search ..... 419/2, 47

(56) References Cited

U.S. PATENT DOCUMENTS 3,645,793 A * 2/1972 Hein et al. ..... 136/24
3,793,060 A * 2/1974 Weininger et al. ..... 117/98
4,614,637 A * 9/1986 Boncoeur et al. ..... 419/2
4,707,184 A * 11/1987 Hashiguchi et al. ..... 75/228
4,707,911 A * 11/1987 Kober et al. ..... 29/623.5
4,777,014 A * 10/1988 Newkirk et al. ..... 419/2

* cited by examiner

*Primary Examiner*—Daniel J. Jenkins
(74) *Attorney, Agent, or Firm*—Rosenberg, Klein & Lee

(57) ABSTRACT

A method for making porous metals that can be used as a filter, a sound-absorbing plate and a line material for a heat exchanger, is manufactured in a simple process using metal powder. The method includes the steps of heating a mixture of a powder-shaped salt and metal powder at a temperature lower than a melting temperature of the salt and higher than a melting temperature of metal powder, to thereby melt the metal powder, pressing and molding the mixture so that the fusion metal is filled into the powder-shaped salt, and erupting the salt from, the plastic body to thereby obtain porous metal. The porous metal having a simple process and a reduced production cost, has an advantageous competitiveness over any or methods for use in a sound-absorbing material or a line material of a neat exchanger, in view of a high pore ratio and a specific surface area.

7 Claims, No Drawings

METHOD FOR MAKING POROUS METALS

BACKGROUND OF THE INVENTION

1. Field of the Invention

The present invention relates to a method for making porous metals, and more particularly, to a method for making porous metals containing consecutive pores of 60–95%, which can be used as a filter, a sound-absorbing plate and a line material for a heat exchanger, In a simple process using metal powder.

2. Description of Prior Art

Porous metals are materials in which consecutive pores have been formed inside substances such as stainless steel, copper alloy, and aluminum alloy. The porous metals are used as a plastic molding filter, an air filter and an oil purification filter, by adjusting the size of the consecutive pores. Also, the porous metals are being noted as a sound-absorbing material by use or an oscillation attenuation phenomenon of sound in the pores. In particular, since it proved that asbestos or glass fibers used for sound-absorbing materials that have been used in abundance in the past are strong carcinogenic substances, they have been replaced with porous metals. In addition to a sound-absorbing material for use in a filter, porous metals can be used as line materials for a heat exchanger or radiator. This is because porous metals can suffice properties of line materials requiring a high thermal conductivity as well as a wide specific surface area.

As described above, in order to use porous metals in the above filters and sound-absorbing materials, pores in the substances should be consecutively connected, a porous ratio should be 60% or more, and a proper mechanical strength should be maintained.

Technologies that have beer developed so far follow with respect to porous metal manufacturing method sufficing the above requirement:

1) Method for thermally hardening metal powder at low density
2) Method for foaming fusion metal with a foaming agent;
3) Method for pressingly casting fusion metals in a perform of sodium chloride; and
4) Method for injecting gypsum slurry in a polyurethane form, thermally decomposing polyurethane, fabricating gypsum mold, and then vacuum absorbing fusion metals.

Among the above methods, the first method has a simple process and an excellent continuity of pores, which have been widely used. However, it is difficult to expect to have a porous ratio of 60% or more and is difficult to be adapted in aluminum alloys.

The second method has a simple process but should use an expensive foaming agent.

In the third method, sodium chloride is molded to have proper pores in advance, fusion metal is pressingly penetrated into the pores, and then sodium chloride is erupted in water to be removed. However, since most metals are extremely low in appetence with sodium chloride, fusion metal Is not nearly penetrated into pores of 1 mm or less even under the considerable pressure using a high-pressure caster. Also, penetration of fusion metal has a considerable difference in the surface and inside the sodium chloride. Thus, the third method has a limitation that it is used for making a rough porous metal having pores of several millimeters in size.

The last method is an application of a precise casting method, and has unique characteristics having a porous ratio of 90% or more and a three-dimensional reticulation, which is appropriate for a filter substance. However, the last method has a complicated process to thereby cause a high cost, and an internal metal of a reticular structure has a small specific surface area. Thus, it is difficult to use the last method in a sound-absorbing material and a line material for a heat exchanger that require a large specific surface area.

As described above, the existing methods for making porous metals have drawbacks such as a low porous ratio, a high cost due to a complicated process, or a small specific surface area.

SUMMARY OF THE INVENTION

To solve the prior art problems, it is an object of the present invention to provide a method for making porous metals having high productivity due to a simple process, a high porous ratio and a high specific surface area.

To accomplish the above object of the present invention, according to the present invention, there is provided a method for making porous metal comprising the steps of: heating a mixture of a powder-shaped salt and metal powder at a temperature lower than a melting temperature of the salt and higher than a melting temperature of metal powder, to thereby melt the metal powder; pressing and molding the mixture so that the fusion metal is filled into the powder-shaped salt; and erupting the salt from the plastic body to thereby obtain porous metal.

The kind of the salt that is used in the present invention is selected taking a plasticity variation Into consideration. That is, if salts are plastically varied, a contact between the salts is sufficiently ensured by a pressing process, to thereby prevent isolation by the fusion metal. Thus, if the plasticity variation of salts does not occur or the degree of the plasticity variation is not sufficient, the isolated salts are not removed in the eruption process of salts, which has bad influence on corrosion-resistance of porous metal.

Thus, considering the above points, it is preferable that a slat that can be used in the present invention is a one-value salt such as sodium chloride or potassium chloride having an excellent plasticity variation.

The size of the pores In the porous metal according o the present invention s decided by the size of the particle of salt powder and the distribution rate of the pores is decided by a mixture ratio of salt and metal powder. Thus, it is possible to properly adjust the size of the salt powder and a mixture ration of the salt and the metal powder according to a use of the porous metal. In general, it is preferable that the size of the particle of the salt powder is 0.05–5 mm and the size of the particle of the metal powder is 10–300 $\mu$m. The metal powder is spherical, oval, needle-shaped or plate-shaped.

Raw powder of a mixture in which salt powder and metal powder are mixed at a predetermined ratio is filled into a mold at which the filled raw powder can be pressed at a predetermined pressure. Then, the mold is heated up to a temperature that is lower than the melting temperature of the salt powder and higher than that or the metal powder. In this case, it is preferable that an air transmission layer is formed on the lower portion of the mold so that air can be discharged through the bottom of the mold before the raw powder of the mixture is filled therein.

A plastic body that is fabricated by pressing and plastering silica powder as an example of the air transmission layer is set in the lower portion of the mold for pressing, and then the mixture raw powder is charged therein. Then, a pressing process is performed. The air transmission layer is a porous plastic body having a capability of inhaling air discharged from the pressed mixture raw powder, and should have no reaction with the fusion metal in the mixture raw powder.

If the mixture raw powder is pressed according to the pressing process in the case that there is no air transmission layer, the fusion metal is not minutely filled in between he salt particles, but pushed out through the cap of the mold by an internal air pressure in the mixture. It is preferable that silica powder of 1–10 $\mu$m is pressingly plastered to use it as an air transmission layer.

Meanwhile, in the case that a thickness of the final product to be obtained is increased, an amount of the raw powder to be charged is increased. Accordingly, the size of the test sample is increased. As a resume, only the air transmission layer formed on the bottom of the mold is insufficient to discharge air. In this case, it is necessary to maintain the internal air pressure to be lower than the atmosphere, by removing the air transmission layer existing between the mixture raw powders in advance.

As a method of removing air existing in the mixture of the salt powder and the metal powder, for example, the mixture raw powder is filled in the mold, the mold is put in a vacuum hot press, and then a vacuum pump can be operated until the internal air pressure reaches a desired vacuum. Otherwise, the mixture raw powder as filled in a container with an air outlet, an inlet of the container is sealed, and then a vacuum pump can be operated until the internal air pressure reaches a desired vacuum.

Here, the vacuum of the mold filled with the mixture of the raw powders or that of the container can be adjusted according to the thickness or use of the porous metal to be obtained, which is preferably equal to or less than 200 mTorr.

At the state when the metal powder has been heated up to the temperature of the melting temperature or higher, the fusion metal such as aluminum continuously maintains the shape of the powder by an oxidation film of the aluminum metal surface.

At this state, the mold is pressed by the press. By the purpose of pressing the mold, an isolation of the salt particles is prevented in which salt is plastically deformed to make a contact between the salt particles sufficiently occur, and at the same time the fusion metal is minutely filled in between the salt particles, in which the oxidation film of the surface on the particle of the fusion metal is destructed. Also, if the pressing force is increased and thus the space between the salt particles is decreased, part of the fusion metal is pushed out through the air transmission layer. Accordingly, an improved pore ratio can be obtained as a result.

In the case that a pressure of a sufficient magnitude is not applied, the space between the salt particles is not filled minutely with the fusion metal. Accordingly, the fabricated porous metal nearly loses a mechanical strength. Thus, the magnitude of the pressing force should be 50 kg/cm$^2$ or more when the temperature is 700° C. By the experimental results, when the heating temperature is equal to or higher than 700° C., it has appeared that a required magnitude of the pressing force is somewhat decreased.

Then, the mold is cooled, and the plastic body test piece separated from the mold is dipped into water to make salt erupt, to thereby obtain porous metal.

As described above, the porous metal making method according to the present invention appears to be similar to the prior art "method for pressingly casting perform fusion metal of sodium chloride" which is simply referred to as a press casting method, but has the following distinctive differences and merits when compared with the press casting method:

Firstly, in the case that the space between the salts constituting a perform is minute in the press casting method, the fusion metal cannot be penetrated even by the press. However, in the present invention, since metal powder is filled in between the salts, the fusion metal can be filled irrespective of the size of the space between the salts. As a result, the porous metal having minute pores can be fabricated, which is difficult to be obtained in the press casting method.

Secondly, the porous metal obtained by the press casting method has a big offset in a pore distribution according to the position of the metal due to the insufficient filling of the fusion metal. The porous metal obtained in the present invention has an extremely uniform pore distribution.

Finally, the press casting method can be applied only in the batch production system. However, in the present invention, a press is installed air. the middle of a sequential heating furnace to enable a sequential mass-production.

DETAILED DESCRIPTION OF THE EMBODIMENT

Preferred embodiments of the present invention will be described below in more detail, with reference to the various examples 1–5.

EXAMPLE 1

1) Sodium chloride powder of 0.7 mm in average diameter and 2024 aluminum alloy powder of 150 $\mu$m manufactured by a gas atomization process have been measured at a weight ratio of 3 to 1 and then mixed with alcohol of 1.5 wt. %.

2) Silica powder of 50 g having a size of 5 $\mu$m has been filled on the bottom of a mold of 100 mm in inner diameter and then pressed under the load of 2 tons, to thereby form a layer through which air is discharged.

3) The uniform mixture of 100 g of the sodium chloride and the aluminum powder prepared in the above step 1) has been filled on the silica layer, and then heated up to 700° C.

4) The mixture of the sodium chloride and aluminum powder has been pressed slowly under she load of up to 2 tons for one minute so that air can be discharged from between the mixtures.

5) The mold has been cooled to separate a plastic body therefrom and then dipped into water to remove salt. In the result of measurement, it has appeared that a average pore size and a pore ratio of the fabricated porous aluminum alloy are 0.7 mm and 83%, respectively. In the result of observing a crossing-section with a scanning electronic microscope (SEM), the aluminum ally has exist in the form of a mutually connected film and an excellent connectivity of pores.

EXAMPLE 2

1) Sodium chloride powder of 0.1 mm in average diameter and pure aluminum alloy powder of 60 $\mu$m manufactured by a gas atomization process have been measured at a weight ratio of 5 to 1 and then mixed with alcohol of 1.5 wt. %.

2) Then, a porous pure aluminum plate has been fabricated in the same method as the Example 1 in which a heating temperature is 720° C. It has appeared that an average pore size and a pore ratio of the fabricated porous aluminum plate are 0.1 mm and 91%, respectively.

EXAMPLE 3

1) Sodium chloride powder of 0.5 mm in average diameter and pure aluminum alloy powder of 150 $\mu$m manufactured by a gas atomization process have been measured at a weight ratio of 4 to 1 and then mixed with alcohol of 1.5 wt. %.

2) Then, a porous pure aluminum plate has been fabricated in the same method as the Example 1 in which a heating temperature is 720° C. It has appeared that an average pore size and a pore ratio of the fabricated porous aluminum plate are 0.1 mm and 91%, respectively.

EXAMPLE 4

1) Metal powder such as pure aluminum and aluminum alloy of 500 g of 200 μm in average diameter and sodium chloride of 1 kg of 500 μm in average diameter have been mixed and tempered for 30 minutes in a ball mill and then filled in a mold of 100 mm in inner diameter.

2) The mold that has been filled with the raw powder has been put in a vacuum hot press and air has been removed from the vacuum chamber using a rotary pump.

3) If a vacuum is decreased down to 200 mTorr, the mold has been heated up to 600° C. and applied under the weight of 3 tons.

4) The Told has been cooled down to 350° C. under the load and thereafter cooled under no load.

5) The mold has been taken out from. the vacuum hot press and then a plastic body has been separated from the mold. The plastic body has been cut in thickness of 10 mm.

6) The cut plastic body has been dipped into water to remove salt, and then dried to fabricate eight sheets of porous aluminum plates of 100 mm in diameter and 10 mm in thickness. In the case of the porous plate fabricated under the above condition, a pore distribution ratio is 82% and an average size of pores is 0.5 mm, in which al the pores have been connected.

EXAMPLE 5

1) Metal powder such as pure aluminum and aluminum alloy of 500 g of 200 μm in average diameter and sodium chloride of 1 kg of 700 μm in average diameter have been mixed and tempered for 30 minutes in a ball mill and then filled in an aluminum alloy container of 96 in inner diameter and 100 mm in outer diameter with an air outlet.

2) The inlet of the container has been sealed and then air has been removed from the container through the air outlet by means of a rotary pump. Then, the air outlet is blocked to make the pressure in the container 100 mTorr or less.

3) The container has been heated up to 630° C. and then has been put in a mold of 10 mm in inner diameter. Then, the mold has been pressed under the load of 3 tons for 30 minutes.

4) At the state where the raw powders have been filled, the pressed container has been separated from the mold and then cooled.

5) The aluminum alloy portion at the upper and sower portions of the container has beer cut and removed. Then, the remaining plastic body has been cut in thickness of 10 mm, and dipped into water to remove salt and then dried. Eight sheets of porous aluminum plates of 100 mm in diameter and 10 mm in thickness in which aluminum alloy layer of 2 mm by hick has been formed, have been fabricated. In the case of the porous plate fabricated under the above condition, a pore distribution ratio is 81% and an average size of pores is 0.7 mm, in which all the pores have been connected.

As described above, the porous metal fabricated in a manner presented in the present invention has an advantageous competitiveness over any prior methods as well as a press casting method for use in a sound-absorbing material or a line material of a heat exchanger, considering a high productivity and a low production cost due to a simple process and a high pore ratio and a specific surface area.

While there have been illustrated and described what are considered 0o be specific preferred embodiments of The present invention, it will be understood by those skilled in he art that the present invention is not limited to the specific embodiments thereof, and various changes and modifications and equivalents may be substituted for elements thereof without departing from the true scope of the present invention.

What is claimed is:

1. A method for making porous metal comprising the steps of:

a. mixing a powder shaped salt and a metal powder to form a mixture;

b. filling the mixture in a mold;

c. heating the mixture at a temperature lower than a melting temperature of the salt and higher than a melting temperature of metal powder, so that the metal powder is changed to a liquid state while the salt powder remains in a solid state, to form a molten powder;

d. pressing the mixture so that the molten metal is filled into the powder-shaped salt, whereby said molten metal is forced between particulates of the salt powder to obtain a compact body;

e. cooling the mold in order to separate the compact body from the mold; and f. removing the salt from the compact body to form a porous metal.

2. The method of claim 1, wherein said salt is sodium chloride or potassium chloride.

3. The method of claim 1, wherein the mold includes an air transmission layer through which air can be discharged.

4. The method of claim 3, wherein said air transmission layer is formed of a pressed silica powder layer.

5. The method of claim 1, wherein an air layer existing between the mixture of said salt and metal powder is removed in advance to maintain the air pressure lower than the atmosphere.

6. The method of claim 5, wherein the removal of the air layer is performed by filling the raw powder mixture into the mold, placing the mold in a vacuum hot press, and operating a vacuum pump.

7. The method of claim 5, wherein the removal of the air layer is performed by filling the raw powder mixture in a container with an air outlet, sealing the inlet of the container, and operating a vacuum pump through the air outlet.

* * * * *

UNITED STATES PATENT AND TRADEMARK OFFICE

CERTIFICATE OF CORRECTION

PATENT NO. : 6,403,023 B1 
DATED : June 11, 2002
INVENTOR(S) : Dong Yik Kim and Sung Kyun Kim It is certified that error appears in the above-identified patent and that said Letters Patent is hereby corrected as shown below:

Title page,
Item [73], delete the letters "(JP)" and insert -- (KR) --

Signed and Sealed this

Fifteenth Day of October, 2002

*Attest:*

*Attesting Officer*

JAMES E. ROGAN
*Director of the United States Patent and Trademark Office*